US010520150B2

(12) United States Patent
Huang et al.

(10) Patent No.: US 10,520,150 B2
(45) Date of Patent: Dec. 31, 2019

(54) IMITATION FLAME DEVICE AND IMITATION FLAME LAMP HAVING THE SAME

(71) Applicants: Guangquan Huang, Dongguan (CN); Shengwei Liu, Huizhou (CN); SHENZHEN TECHLONG CO., LTD, Shenzhen (CN)

(72) Inventors: Guangquan Huang, Dongguan (CN); Shengwei Liu, Huizhou (CN)

(73) Assignees: Guangquan Huang, Dongguan (CN); Shengwei Liu, Huizhou (CN); SHENZHEN TECHLONG CO., LTD., Shenzhen (CN)

( * ) Notice: Subject to any disclaimer, the term of this patent is extended or adjusted under 35 U.S.C. 154(b) by 0 days.

(21) Appl. No.: 16/244,635

(22) Filed: Jan. 10, 2019

(65) Prior Publication Data

US 2019/0145593 A1 May 16, 2019

(30) Foreign Application Priority Data

Oct. 29, 2018 (CN) ..... 2018 1 1268348

(51) Int. Cl.
*F21V 5/00* (2018.01)
*F21S 10/04* (2006.01)
(Continued)

(52) U.S. Cl.
CPC ..... *F21S 10/046* (2013.01); *F21S 6/001* (2013.01); *F21S 9/02* (2013.01); *F21V 23/005* (2013.01);
(Continued)

(58) Field of Classification Search
CPC . F21S 10/046; F21S 9/02; F21S 6/001; F21V 23/06; F21V 23/006; F21V 23/005;
(Continued)

(56) References Cited

U.S. PATENT DOCUMENTS

2014/0218903 A1 8/2014 Sheng
2016/0116127 A1* 4/2016 Patton ..... F21S 6/001 362/284

(Continued)

FOREIGN PATENT DOCUMENTS

CN 107035992 A 8/2017
CN 108286696 A 7/2018
DE 202016103542 U1 7/2016

*Primary Examiner* — Ali Alavi
(74) *Attorney, Agent, or Firm* — Shimokaji IP

(57) ABSTRACT

An imitation flame device includes a base, a flame component, a swing support, a first magnet, and a ferromagnetic element. The swing support is configured in the base, the flame component is fixed on the swing support and protruded out of the base, one of the first magnet and the ferromagnetic element is installed in the base, another of the first magnet and the ferromagnetic element is fixed on the swing support, the first magnet and the ferromagnetic element are attracted each other to cause the swing support to suspend within the base, and the first magnet and the ferromagnetic element are in point contact. The device shows flaming effect of faux flame to achieve an excellent imitation effect and saves energy.

7 Claims, 6 Drawing Sheets

(51) Int. Cl.

| | |
|---|---|
| ***F21S 6/00*** | (2006.01) |
| ***F21S 9/02*** | (2006.01) |
| ***F21V 23/00*** | (2015.01) |
| ***F21V 23/06*** | (2006.01) |
| *F21Y 115/10* | (2016.01) |
| *F21W 121/00* | (2006.01) |

(52) U.S. Cl.
CPC ..... *F21V 23/06* (2013.01); *F21V 23/006* (2013.01); *F21W 2121/00* (2013.01); *F21Y 2115/10* (2016.08)

(58) Field of Classification Search
CPC .. F21V 23/03; F21Y 2115/10; F21W 2121/00
USPC ..... 362/569
See application file for complete search history.

(56) References Cited

U.S. PATENT DOCUMENTS

| | | | | |
|---|---|---|---|---|
| 2016/0258586 | A1* | 9/2016 | Patton | F21S 10/046 |
| 2017/0038020 | A1* | 2/2017 | Patton | F21S 6/001 |
| 2017/0067608 | A1* | 3/2017 | Patton | F21S 10/046 |
| 2017/0122512 | A1 | 5/2017 | Yuan | |
| 2017/0130918 | A1* | 5/2017 | Li | F21S 10/046 |
| 2017/0159901 | A1* | 6/2017 | Li | F21S 10/046 |
| 2017/0191633 | A1* | 7/2017 | Patton | G02B 6/00 |
| 2017/0254494 | A1 | 9/2017 | Patton | |
| 2018/0306396 | A1* | 10/2018 | Patton | F21K 9/235 |

* cited by examiner

IMITATION FLAME DEVICE AND IMITATION FLAME LAMP HAVING THE SAME

RELATED APPLICATIONS

This application claims the benefits of Chinese Patent Application No. 201811268348.3, filed on Oct. 29, 2018, the entire contents of which are hereby incorporated by reference in this application.

FIELD OF THE INVENTION

The present invention relates to an imitation flame device, and more particularly to an imitation flame device and an imitation flame lamp having the same.

BACKGROUND OF THE INVENTION

Currently, for creating ambience in certain occasions, people often use imitation candle lamps to imitate actual candle flame effect.

A conventional imitation candle lamp commonly includes a housing, a base, a driving mechanism, an illuminant, a cover for covering the illuminant and a swing assembly. Specifically, the swing assembly and the driving device are configured in the base, the base is configured in the housing, and the cover together with the illuminant are configured on the housing and fixed to the swing assembly. In the actual applications, the swing assembly is driven by the driving device to cause the illuminant together with the cover to swing, thereby obtaining faux flame effect. However, in the conventional faux flame lamp, for making the swing assembly to swing and fix in the base meanwhile, a metallic wire is utilized to run through the swing assembly. In such a way, the swing motions of the swing assembly will be limited by the metallic wire thereby the faux flame effect is poor and stiff. Furthermore, since the friction between the metallic wire and the swing assembly is large, thus more electric energy is required when the imitation flame lamp is in use.

Therefore, there is a need to provide an improved imitation flame device which shows flaming effect of faux flame to achieve an excellent imitation effect and saves energy.

SUMMARY OF THE INVENTION

One objective of the present invention is to provide an imitation flame device which shows flaming effect of faux flame to achieve an excellent imitation effect and saves energy.

Another objective of the present invention is to provide an imitation flame lamp which shows flaming effect of faux flame to achieve an excellent imitation effect and saves energy.

To achieve the mentioned above objectives, the present invention provides an imitation flame device, comprising a base, a flame component, a swing support, a first magnet, and a ferromagnetic element, wherein the swing support is configured in the base, the flame component is fixed on the swing support and protruded out of the base, one of the first magnet and the ferromagnetic element is installed in the base, another of the first magnet and the ferromagnetic element is fixed on the swing support, the first magnet and the ferromagnetic element are attracted each other to cause the swing support to suspend within the base, and the first magnet and the ferromagnetic element are in point contact.

Preferably, at least one of the first magnet and the ferromagnetic element has a tip which is for the point contact.

Preferably, the swing support comprises a support body, an arch part located at the support body, and a connecting part located at the arch part, the connecting part is provided with a connecting hole running through the connecting part and connected with the flame component.

Preferably, the imitation flame device further includes a suspension lever located in the base, one end of the suspension lever is connected with an inner wall of the base, and a free end of the suspension is extended below the arch part, the first magnet is installed in the free end of the suspension, and the support body is provided with a location hole that is connected with the ferromagnetic element.

Preferably, the free end of the suspension lever is provided with a limiting part that is annular, and a notch is formed on an annular wall of the limiting part, the first magnet is exposed to a space defined in the limiting part, and the ferromagnetic element is extended into the space defined in the limiting part to contact with the first magnet.

Preferably, an engagement part is formed at an inner wall of the first base part to engage with the suspension lever.

Preferably, the arch part is in an inverted U shape, and two guide holes are provided at two sides of the arch part to allow copper wires to pass and connect with a control circuit board.

Preferably, the flame component includes an illuminant which has pins running through the connecting hole and extending out of the arch part, and a cover fixed to the connecting base.

The present invention further provides an imitation flame lamp, comprising a housing, a power box, a control circuit board, a driving device, and the imitation flame device, wherein the flame component is protruded out of the housing, the swing support together with the flame component mounted on the swing support are driven by the driving device.

Preferably, the driving device comprises a second magnet and a coil, the second magnet is fixed at a bottom of the swing support, the coil and the control circuit board are located in the base and beneath the swing support, and the coil generates an electromagnetic field under a control of the control circuit board.

In comparison with the prior art, one of the first magnet and the ferromagnetic element is installed in the base, and the other of the first magnet and the ferromagnetic element is fixed to the swing support, by means of the attraction between the first magnet and the ferromagnetic element, the swing support together with the flame component on the swing support are positioned and suspended, and the swing support can be mounted on the base or detached from the base easily. Furthermore, by means of the point contact between the first magnet and the ferromagnetic element, the limitation to the swing support is greatly reduced due to the small contact surface therebetween, therefore the swing support can swing at different directions when subjected to an external force, and the swings of the swing support are more natural and lifelike to obtain an improved imitation effect. Since the swing support is only subjected to a restraining force of one point, therefore the swing support and the flame component can swing more stably under the action of inertia, thereby effectively reducing the number of power-on drive, saving electric energy, and extending the battery life.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

The present invention will be described in detail below with reference to the accompanying drawings and preferred embodiments.

Figure 1:
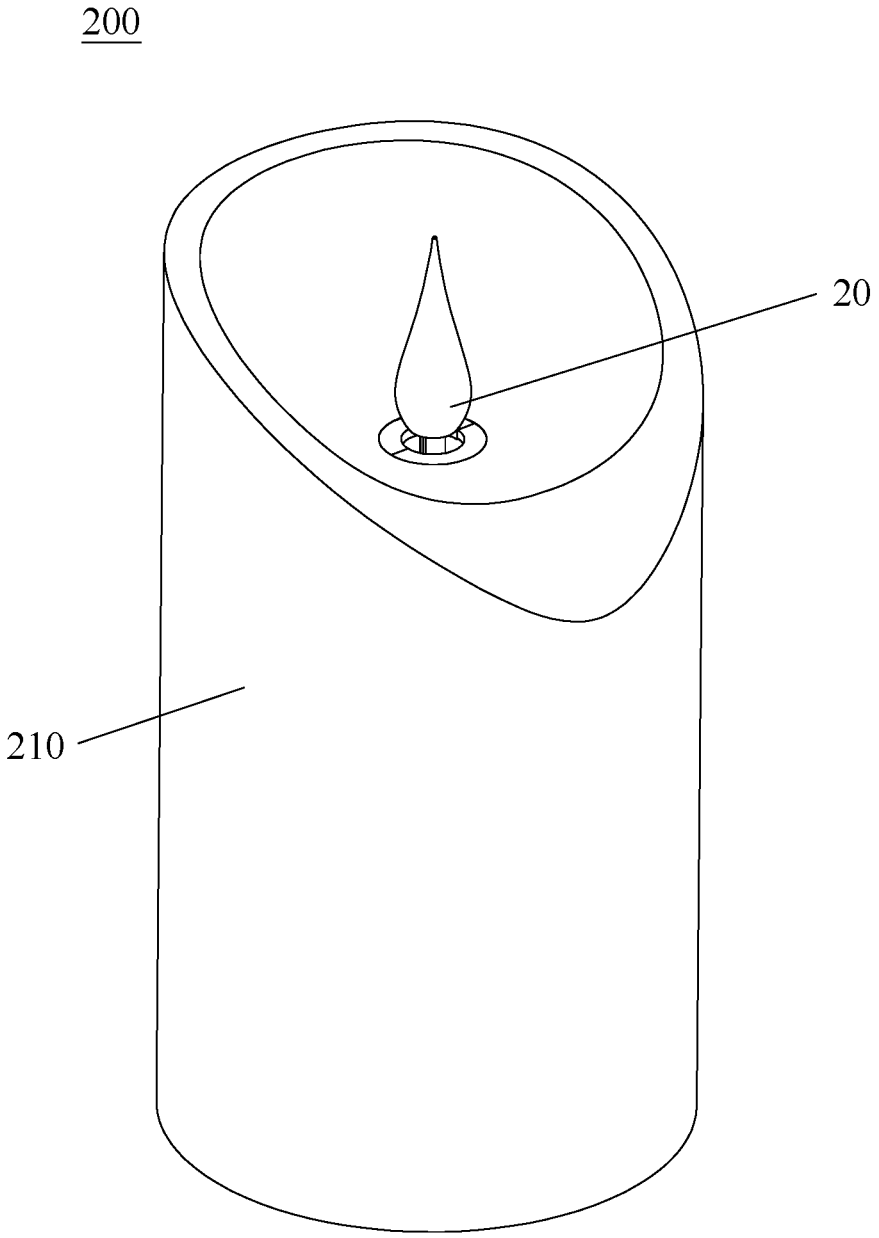
FIG. 1 is a perspective view of an imitation flame lamp according to an embodiment of the present invention.
Figure 2:
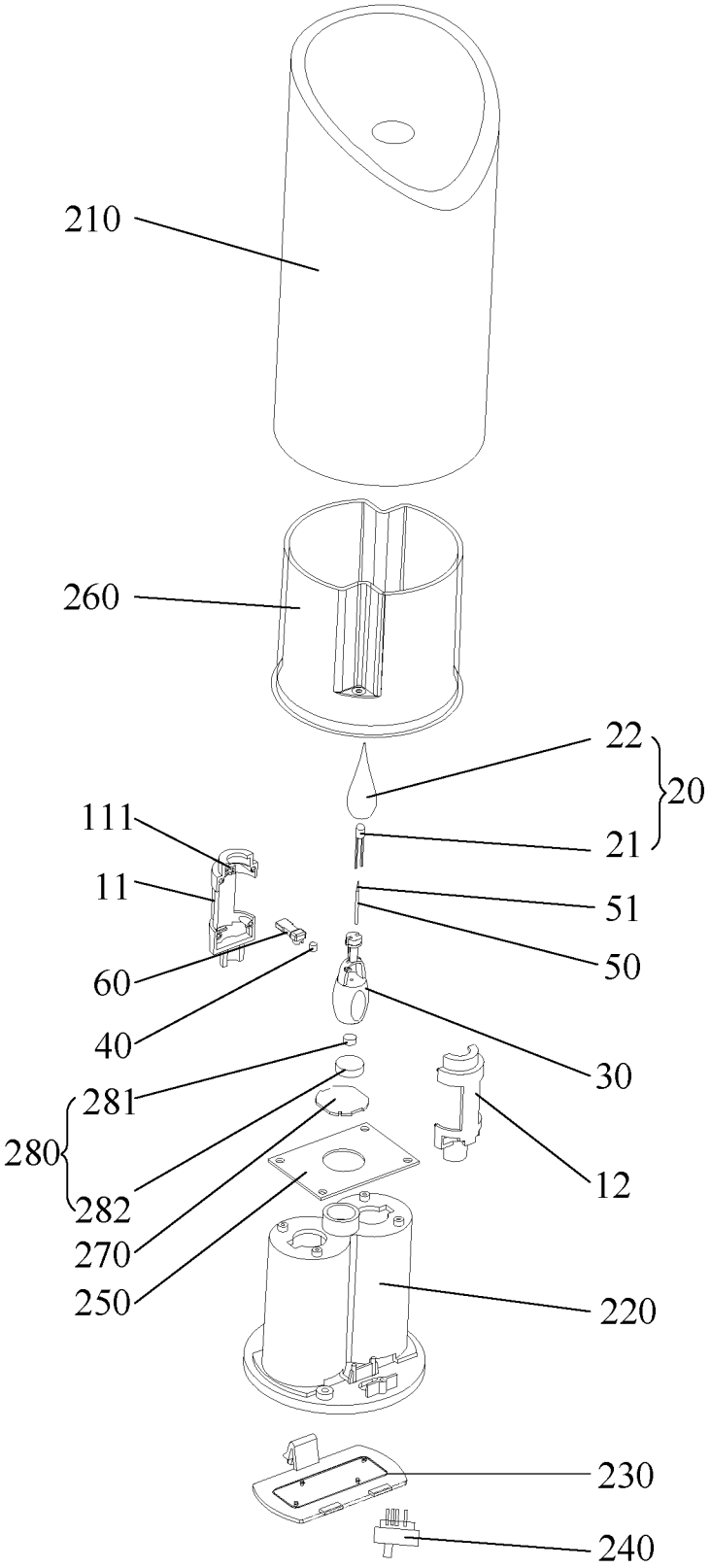
FIG. 2 is an exploded view of the imitation flame lamp according to an embodiment of the present invention.
Figure 3:
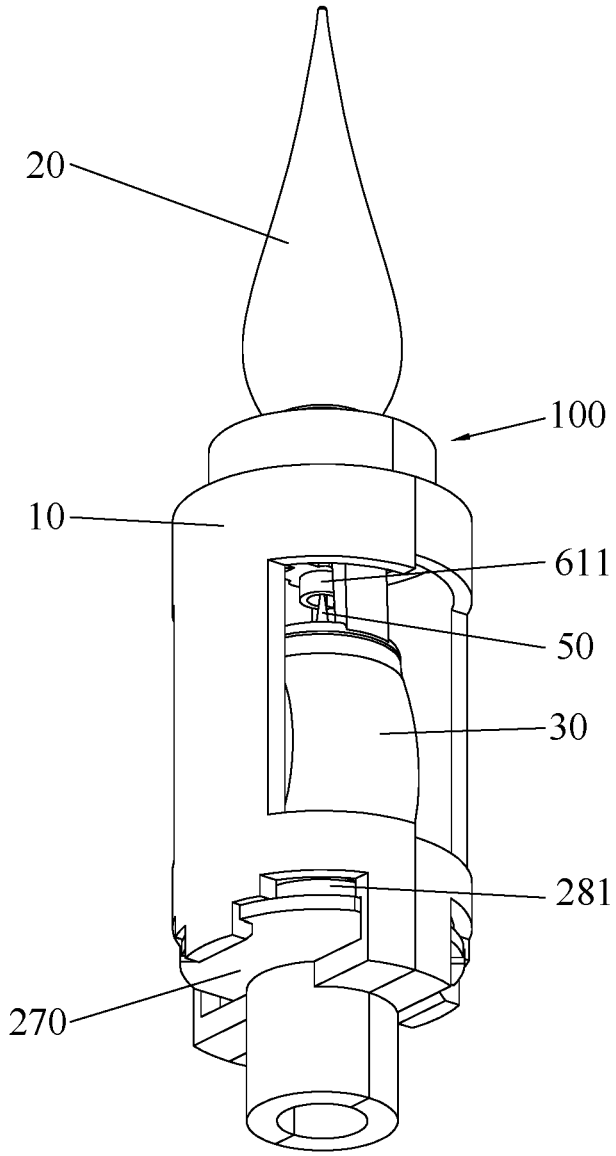
FIG. 3 is a perspective view of an imitation flame device with a driver installed thereon according to an embodiment of the present invention.
Figure 4:
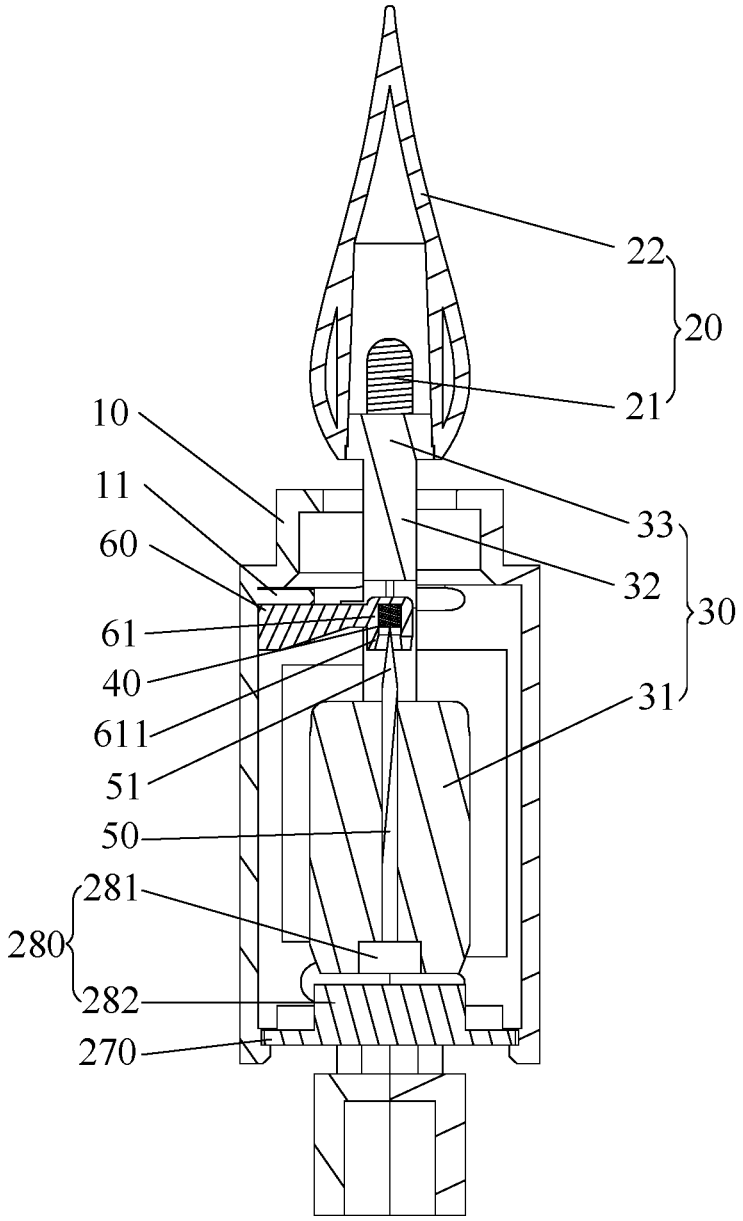
FIG. 4 is a sectional view of the imitation flame device according to an embodiment of the present invention.
Figure 5:
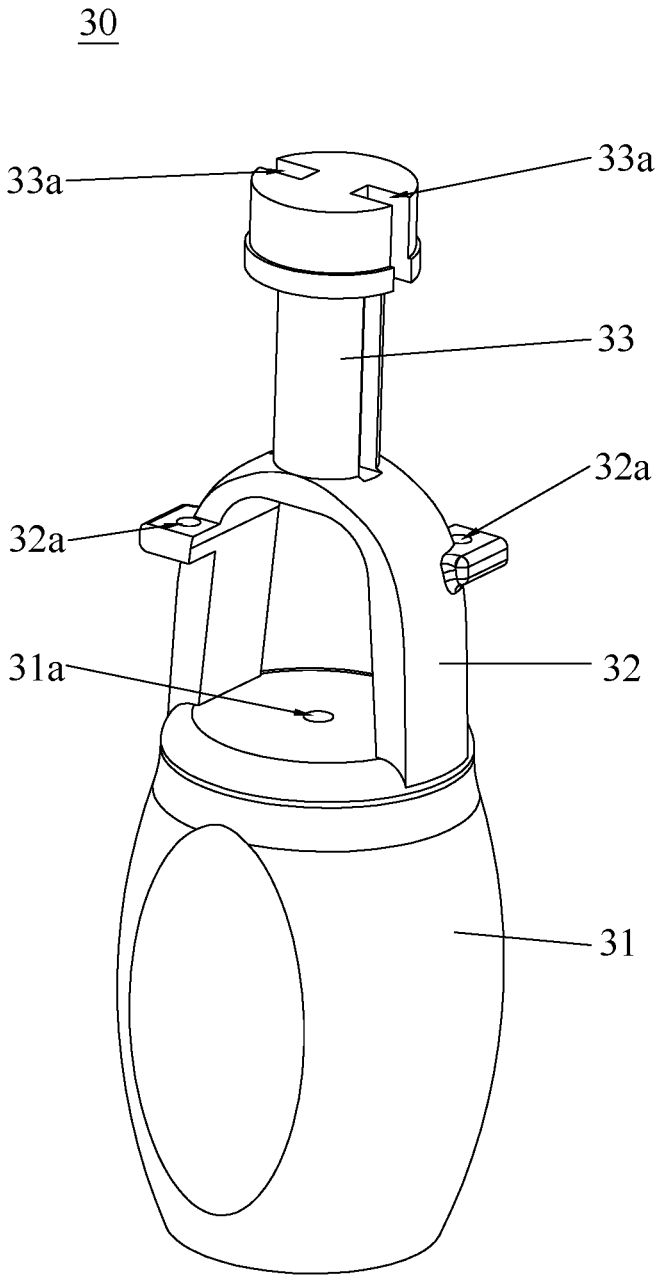
FIG. 5 is a perspective view of a swing support of the imitation flame device according to an embodiment of the present invention.
Figure 6:
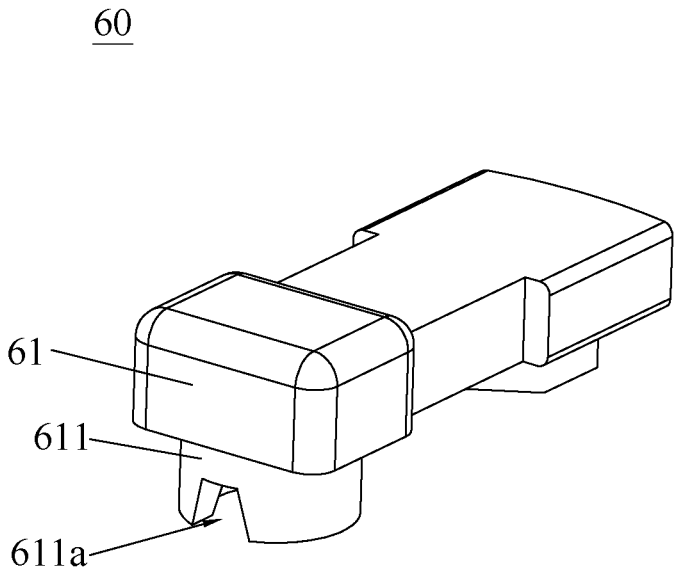
FIG. 6 is a perspective view of a suspension lever of the imitation flame device according to an embodiment of the present invention.

As illustrated in FIGS. 1 and 2, an imitation flame lamp 200 of the present invention includes a housing 210, a power box 220, a power cover 230, a switch 240, an adapter board 250, an inner cover 260, a control circuit board 270, a driving device 280 and an imitation flame device 100 which are installed inside the housing 210 respectively. specifically, the power cover 230 is configured beneath the power box 220, the adapter board 250 is configured at the top of the power box 220, the power box 220 is received in the inner cover 260, the control circuit board 270 is electrically connected with the power box 220 via the switch 240, a flame component 20 of the imitation flame device 100 is protruded out of the top of the housing 210 and electrically connected with the control circuit board 270, and the driving device 280 is electrically connected with the control circuit board 270 to actuate a swing support 30 and the flame component of the imitation flame device 100. Preferably, the housing 210 is in a candle shape, thereby improving the imitation effect.

Referring to FIGS. 2-5, the driving device 280 includes a base 10, a flame component 20, a swing support 30, a first magnet 40 and a ferromagnetic element 50. Specifically, the base 10 includes a first base part 11 and a second base part 12 which are assembled with each other by means of engagement, in such a way, the base 10 is detachable, and the swing support 30 can be placed in the base 10 or removed from the base 10 quickly. The flame component 20 is fixed on the base 10 and protruded out of the base 10, the first magnet 40 is mounted in the base 10, one end of the ferromagnetic element 50 is inserted into the base 10, the other end of the ferromagnetic element 50 is protruded from the base 10 to attract the first magnet 40 thereby making the swing support 30 suspend in the base 10. Therefore, by means of the attraction between the first magnet 40 and the ferromagnetic element 50, the swing support 30 together with the flame component 20 are suspended and positioned, and the swing support 30 is detachable. Further, since the first magnet 40 and the ferromagnetic element 50 are in point contact, thus the limitation to the swing support 30 is greatly reduced, the swing support 30 can swing more stably under the action of an external force, the swing motion of the swing support 30 is more natural, and the simulation effect is improved. Furthermore, it effectively reduces the number of power-on drive and saves power, thereby extending battery life and being environmentally friendly.

Preferably, the ferromagnetic element 50 is a metal piece, such as a iron needle which is protruded out of the base 10 and has a tip 51 contacting with the first magnet 40. It's noted that, the positions of the first magnet 40 and the ferromagnetic element 50 can be exchanged, that is, the first magnet 40 is fixed to the swing support 30 while the ferromagnetic element 50 is mounted in the base 10, so that the ferromagnetic element 50 is attracted with the first magnet 40 to suspend the swing support 30 in the base. Additionally, for achieving the point contact between the first magnet and the swing support 30, the shapes of both the first magnet 40 and the swing support 30 can be globular, or a tip is configured at the joint position between the first magnet 40 and the first ferromagnetic element 50, or two tips are configured at the first magnet 40 and the first ferromagnetic element 50 respectively, for contacting.

Preferably, as shown in FIG. 2, the driving device 280 includes a second magnet 281 and a coil 282, the second magnet 281 is fixed on the bottom of the swing support 30, and the coil 282 and the control circuit board 270 are located within the base 10 and beneath the swing support 30. Under the control of the control circuit board 270, the coil 282 generates an electromagnetic field to cause the second magnet 281 to actuate the swing support 30.

Please refer to FIGS. 2-5, the swing support 30 includes a support body 31, an arch part 32 and a connecting base 33. Specifically, the arch part 32 is located at the support body 31 and arched upwards, the connecting base 32 is formed on the arch part 32 and provided with a connecting hole 33*a* which runs through the connecting base 33 from top to bottom and is adapted for connecting with the flame component 20, and the support body 31 is provided with a locating hole 31*a* which is adapted for connecting with the ferromagnetic element 50. Specifically, the arch part 32 is in an inverted U shape, and two guide holes 32 are provided at two sides of the arch part 32 to allow copper wire to pass and connect with the control circuit board 270, therefore, the copper wire is guided and limited.

As illustrated in FIGS. 2, 3, 4 and 6, the imitation flame device 100 further includes a suspension lever 60 located in the base 10, and an engagement part 111 is formed at the inner wall of the first base part 11 to engage with the suspension lever 60. Specifically, one end of the suspension lever 60 is engaged with the engagement part 111, and a free end 61 of the suspension lever 60 is extended to locate below the arch part 32. More specifically, the free end 61 of the suspension lever 60 is provided with a limiting part 611 that is annular, the first magnet 40 is installed in the free end 61 of the suspension lever 60 and exposed at the space defined by the limiting part 611, the tip 50 of the ferromagnetic element 50 is extended into the space defined in the limiting part 611 to contact with the first magnet 40. Further, the swing support 30 is prevented from going beyond an attraction distance of the first magnet 40 due to a severe swing motion. Meanwhile, a notch 611*a* is formed on the wall of the limiting part 611 to allow the ferromagnetic element 50 to pass through.

As illustrated in FIGS. 1-4, the flame component 20 includes an illuminant 21 and a cover 22. Specifically, the cover 22 is fixed to the connecting base 33, pins of the illuminant 21 runs through the connecting hole 33*a* and extends of the arch part 32, that is, a lead runs through the connecting hole 33*a* to connect with the pins of the arch part 32, therefore the connecting hole 33*a* protects the pins of the illuminant 21 from being bent a plurality of times due to the sway of the swing support 30, thereby extending the lifetime of the illuminant 21. Preferably, the illuminant 21 is a LED, or other light sources of course.

It should be noted that, the first magnet 40 and the second magnet 281 are referred to an object such as a magnet that can generate a magnetic field, which has characteristics of attracting ferromagnetic substances. Correspondingly, the ferromagnetic element 50 in the present invention is referred to an object made of a material having a magnetization phenomenon, which can be attracted to a strong magnet such as a magnet, for example a transition metal such as iron, cobalt, nickel, and rhodium, or objects made of their alloys and compounds.

In comparison with the prior art, one of the first magnet 40 and the ferromagnetic element 50 is installed in the base 10, and the other of the first magnet 40 and the ferromagnetic element 50 is fixed to the swing support 30, by means of the attraction between the first magnet 40 and the ferromagnetic element 50, the swing support 30 and the flame component 20 on the swing support 30 are positioned and suspended, and the swing support 30 can be mounted on the base 10 or detached from the base easily. Furthermore, by means of the point contact between the first magnet 40 and the ferromagnetic element 50, the limitation to the swing support 30 is greatly reduced due to the small contact surface therebetween, therefore the swing support 30 can swing at different directions when subjected to an external force, and the swings of the swing support 30 are more natural and lifelike to obtain an improved imitation effect. Since the swing support 30 is only subjected to a restraining force of one point, therefore the swing support 30 and the flame component 20 can swing more stably under the action of inertia, thereby effectively reducing the number of energization driving, saving electric energy, and extending the battery life.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An imitation flame device, comprising a base, a flame component, a swing support, a first magnet, and a ferromagnetic element, wherein the swing support is configured in the base, the flame component is fixed on the swing support and protruded out of the base, one of the first magnet and the ferromagnetic element is installed in the base, another of the first magnet and the ferromagnetic element is fixed on the swing support, the first magnet and the ferromagnetic element are attracted each other to cause the swing support to suspend within the base, and the first magnet and the ferromagnetic element are in point contact;

wherein the swing support comprises a support body, an arch part located at the support body, and a connecting part located at the arch part, the connecting part is provided with a connecting hole running through the connecting part and connected with the flame component;

the imitation flame device further comprises a suspension lever located in the base, one end of the suspension lever is connected with an inner wall of the base, and a free end of the suspension is extended below the arch part, the first magnet is installed in the free end of the suspension, and the support body is provided with a location hole that is connected with the ferromagnetic element;

the free end of the suspension lever is provided with a limiting part that is annular, and a notch is formed on an annular wall of the limiting part, the first magnet is exposed to a space defined in the limiting part, and the ferromagnetic element is extended into the space defined in the limiting part to contact with the first magnet.

2. The imitation flame device according to claim 1, wherein at least one of the first magnet and the ferromagnetic element has a tip which is for the point contact.

3. The imitation flame device according to claim 1, wherein an engagement part is formed at an inner wall of the first base part to engage with the suspension lever.

4. The imitation flame device according to claim 1, wherein the arch part is in an inverted U shape, and two guide holes are provided at two sides of the arch part to allow copper wires to pass and connect with a control circuit board.

5. The imitation flame device according to claim 1, wherein the flame component includes an illuminant which has pins running through the connecting hole and extending out of the arch part, and a cover fixed to the connecting base.

6. An imitation flame lamp, comprising a housing, a power box, a control circuit board, a driving device, and the imitation flame device according to claim 1, wherein the flame component is protruded out of the housing, the swing support together with the flame component mounted on the swing support are driven by the driving device.

7. The imitation flame device according to claim 6, wherein the driving device comprises a second magnet and a coil, the second magnet is fixed at a bottom of the swing support, the coil and the control circuit board are located in the base and beneath the swing support, and the coil generates an electromagnetic field under a control of the control circuit board.

* * * * *